US006116748A

United States Patent [19]

George

[11] Patent Number: 6,116,748

[45] Date of Patent: Sep. 12, 2000

[54] AISLE LIGHTING SYSTEM

[75] Inventor: James F. George, Tustin, Calif.

[73] Assignee: Permlight Products, Inc., Tustin, Calif.

[21] Appl. No.: 09/098,814

[22] Filed: Jun. 17, 1998

[51] Int. Cl.[7] ..... F21V 33/00

[52] U.S. Cl. ..... 362/145; 153/127; 153/131; 153/249; 153/2; 153/246

[58] Field of Search ..... 362/145, 146, 362/153, 127, 131, 249, 268, 235, 237, 240, 245, 244

[56] References Cited

U.S. PATENT DOCUMENTS

| | | | |
|---|---|---|---|
| D. 311,588 | 10/1990 | Nagano . | |
| D. 312,135 | 11/1990 | Nagano . | |
| 3,500,036 | 3/1970 | Szentveri . | |
| 3,663,808 | 5/1972 | Baatz . | |
| 3,692,993 | 9/1972 | Robinson . | |
| 3,885,144 | 5/1975 | Lewis et al. . | |
| 4,143,411 | 3/1979 | Roberts . | |
| 4,271,458 | 6/1981 | George, Jr. . | |
| 4,337,759 | 7/1982 | Popovich et al. . | |
| 4,544,996 | 10/1985 | George . | |
| 4,612,606 | 9/1986 | Roberts . | |
| 4,625,266 | 11/1986 | Winter . | |
| 4,665,470 | 5/1987 | George, Jr. . | |
| 4,855,882 | 8/1989 | Boss . | |
| 4,907,361 | 3/1990 | Villard . | |
| 4,908,743 | 3/1990 | Miller . | |
| 4,943,900 | 7/1990 | Gartner . | |
| 4,945,675 | 8/1990 | Kendrick . | |
| 5,045,981 | 9/1991 | Nagano . | |
| 5,103,382 | 4/1992 | Kondo et al. . | |
| 5,174,649 | 12/1992 | Alston | 362/244 |
| 5,222,799 | 6/1993 | Sears et al. . | |
| 5,404,869 | 4/1995 | Parkyn, Jr. et al. . | |
| 5,430,627 | 7/1995 | Nagano . | |
| 5,499,170 | 3/1996 | Gagne . | |
| 5,594,628 | 1/1997 | Reuter et al. . | |
| 5,607,227 | 3/1997 | Yasumoto et al. . | |
| 5,810,468 | 9/1998 | Shimada | 362/146 |

OTHER PUBLICATIONS

"Tivoli™ the light fantastic"—Brochure.

"Innovative Illumination"—Tir Technologies, Inc. Brochure.

"Need Light . . . Want to be the Brightest?"—Teledyne Electronic Technologies—Brochure.

"Super Flux LEDs"—Hewlett Packard catalog—pp. 1–25, 1–26.

"Escort Lights"—Tivoli—Aisle Lighting Systems, Extrusion, Tivoli Replacement Lamp System, Lens Cover, Brochure.

*Primary Examiner*—Thomas M. Sember

*Attorney, Agent, or Firm*—Knobbe, Martens, Olson & Bear, LLP

[57] ABSTRACT

A lighting system provided for illuminating a region of an aisle in a theater, auditorium or the like, comprises a light housing attached to an aisle-side of a row-end theater or auditorium seat. Four individual miniature electric light sources, preferably high intensity light emitting diodes (LED's), provide the illumination, and are mounted in the housing at a downwardly and outwardly facing housing window. A first focusing columniating primary lens installed in front of each LED and a second shaping secondary lens strip installed in series in front of the LED's focus columniate and shape light emitted by the LED's so as to cause illumination of a specific below-adjacent region of said aisle.

10 Claims, 4 Drawing Sheets

AISLE LIGHTING SYSTEM

BACKGROUND OF THE INVENTION

1. Field of the Invention

The present invention relates generally to the field of lighting systems and more particularly to relatively low-level lighting systems for lighting aisles of theaters, auditoriums and the like.

2. Background Discussion

Many theaters, auditoriums and the like have front-to-back aisles which separate rows of seats. Often the floor on which the rows of seats are mounted is upwardly inclined at a shallow angle, so that patrons sitting in one row of seats can see a stage over the heads of patrons sitting in a next-adjacent forward row of seats.

As a consequence, the aisles, which run at a right angle to the rows of sears, are inclined at the angle of the floor. Alternatively, as is more typical, such aisles have shallow steps or risers, usually with several feet of level walking surfaces between the steps. Because such steps do not conform to ordinary steps in which the risers and flat surfaces are nearly equal in size-with the flat surfaces being only slightly wider than the height of the risers-walking on this type of aisle is unnatural and can result in mis-steps and falls by the patrons, especially in a darkened theater or auditorium.

In some darkened theaters or auditoriums, ushers are provided who guide patrons to their seats. These ushers, which are becoming less and less prevalent, ordinarily use small flashlights to illuminate the aisles they traverse. Even where such ushers are provided, they are available only to initially guide patrons to their seats and are not available at all rows of seats to guide already seated patrons back to the lobby to purchase snacks or to go to restrooms.

It is, therefore, desirable to provide for continually illuminated aisles, and some form of aisle lighting is known to be provided on theater seats next to the aisles. A major problem, however, is that although the aisle lighting must be sufficiently bright to illuminate the aisles so that patrons are not at risk of stumbling and falling, the illumination must be dim enough so that it does not annoy or distract patrons viewing, for example, a motion picture. Insofar as is known to the present inventor, aisle lighting on row-end seats is either too dim as to inadequately light adjacent aisles or is so bright as to be distracting or annoying to at least those patrons who are seated adjacent the aisles.

A principal objective of the present invention is therefore, to provide an aisle illumination source on row-end seats that is configured for providing adequate aisle lighting but which is not, at the same time, distracting or annoying to patrons seated adjacent or near the aisles.

SUMMARY OF THE INVENTION

In accordance with the present invention, there is provided a system for illuminating a specific region of an aisle in a theater, auditorium or the like. The lighting system comprises a light housing and means for attaching the housing to an aisle-side of a row-end theater or auditorium seat, and at least one individual miniature electric light source installed in the housing for enabling the light therefrom to be directed at an outwardly and downwardly facing housing window so that light from the source is directed onto specific below-adjacent regions of the aisle.

Included in the system are primary light focusing intensifying collimating lens and secondary shaping lenses disposed in front of the at least one light source so as to create the illuminated region of the aisle.

Preferably, the at least one light source comprises a high intensity light emitting diode (LED); more preferably, there are included four such light sources, each of which is a high intensity LED, and which are mounted to a printed circuit card in a spaced-apart relationship.

In accordance with a preferred embodiment of the invention, a light focused intensifying collimating primary lens strip is installed in front of the printed LED circuit card and a light shaping secondary lens strip is installed in front of the light focusing intensifying collimating primary lens strip, in which case, the light focusing intensifying collimating primary lens strip includes an individual collimating lens, each in optical alignment with each of the LED light sources.

BRIEF DESCRIPTION OF THE DRAWINGS:

The present invention can be more readily understood by a consideration of the following detailed description when taken in conjunction with the accompanying drawings, in which.

In the various FIGS. the same elements and features are given the same reference numbers.

DESCRIPTION OF THE PREFERRED EMBODIMENT

Figure 1:
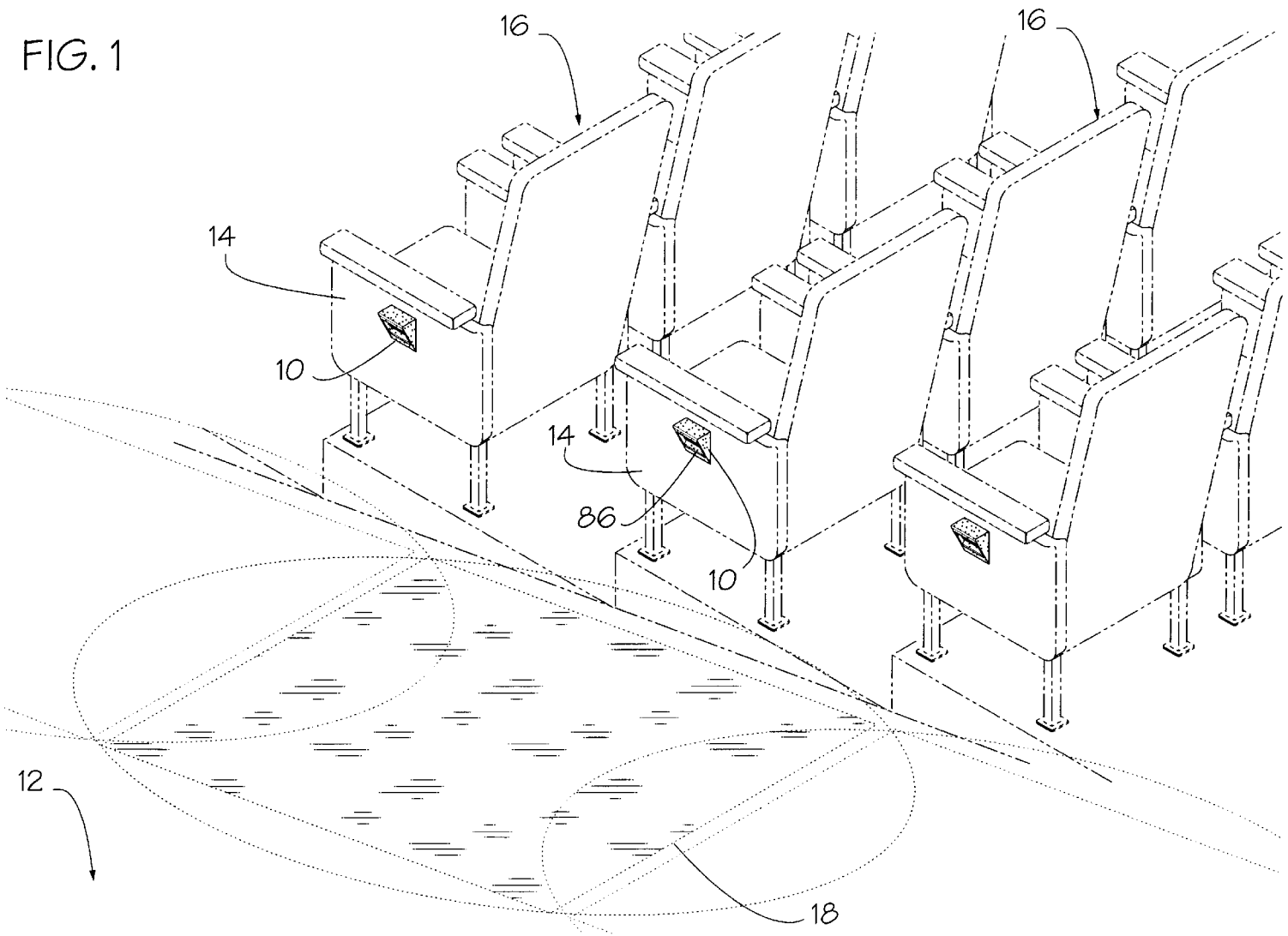
FIG. 1 is a perspective drawing depicting an existing patron seating arrangement adjacent to an exemplary stepped aisle, and showing an aisle illumination or lighting system in accordance with the present invention installed on sides of seats which are adjacent to the aisle.
Figure 2:
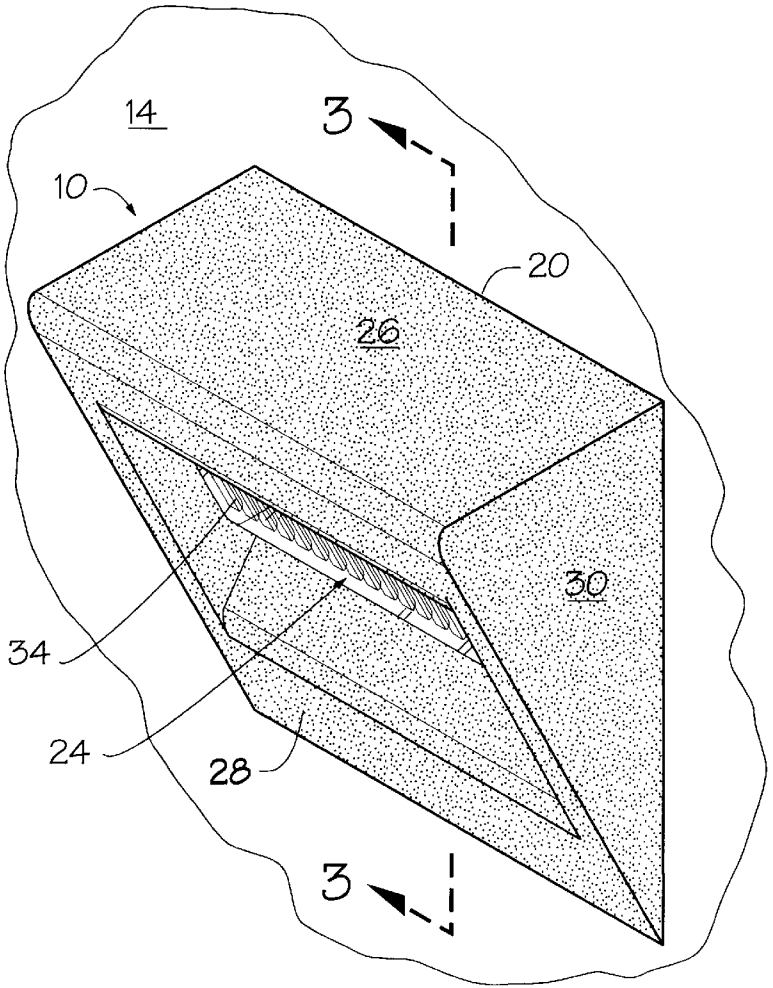
FIG. 2 is a perspective drawing showing the aisle illumination system in larger detail, including a light shaping lens portion of a lighting assembly recessed in the housing and facing downwardly and outwardly.

There is shown in FIGS. 1 and 2 an illumination system or means 10 for illuminating an aisle 12 of a theater, auditorium or the like (not shown). Aisle illuminating system 10 is shown installed on an aisle-facing side 14 of a preexisting row-end seat 16 which is adjacent to aisle 12.

Figure 3:
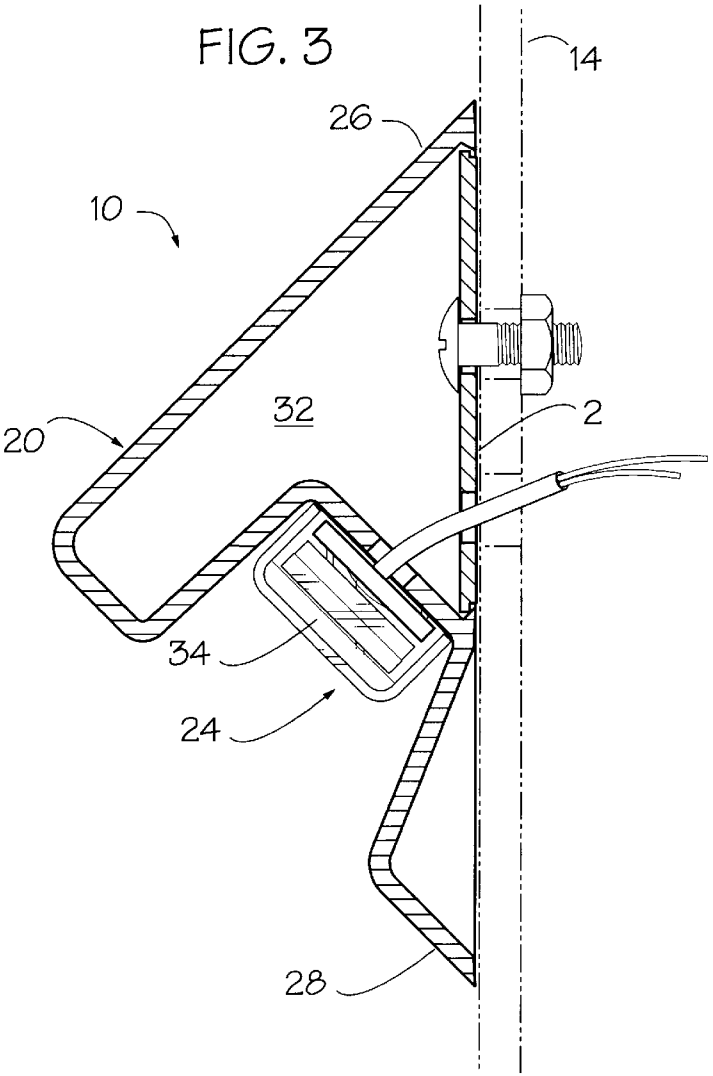
FIG. 3 is a transverse cross sectional drawing, taken along line 3—3 of FIG. 2 showing attachment of the housing to the seat side and showing the internally-mounted lighting assembly installed in the housing.

As more particularly described below, aisle illuminating system 10 is configured and is mounted to seat side 14 so as to provide a relatively-uniformly illuminated or lighted region 18 on aisle 12 adjacent to the end seat 16. As shown, illuminated region 18 may, as is shown in FIG. 1, be generally elliptical or rectangular in shape. Comprising system 10 as shown in FIGS. 2 and 3, are a housing 20, a lighting or illumination assembly 24 and a light source attaching bracket 26 which forms a rearward part of housing

20. Housing 20, which is shown formed having a generally triangular shape in transverse cross section, includes an upper, downwardly and outwardly sloping wall portion 26, a lower downwardly and inwardly sloping wall portion 28, and first and second outwardly extending side or end wall portions 30 and 32.

Lighting or illumination assembly 24 is installed inside of housing 20 at a housing window 34 formed or defined in housing lower portion 28 and that faces outwardly and downwardly.

Figure 4:
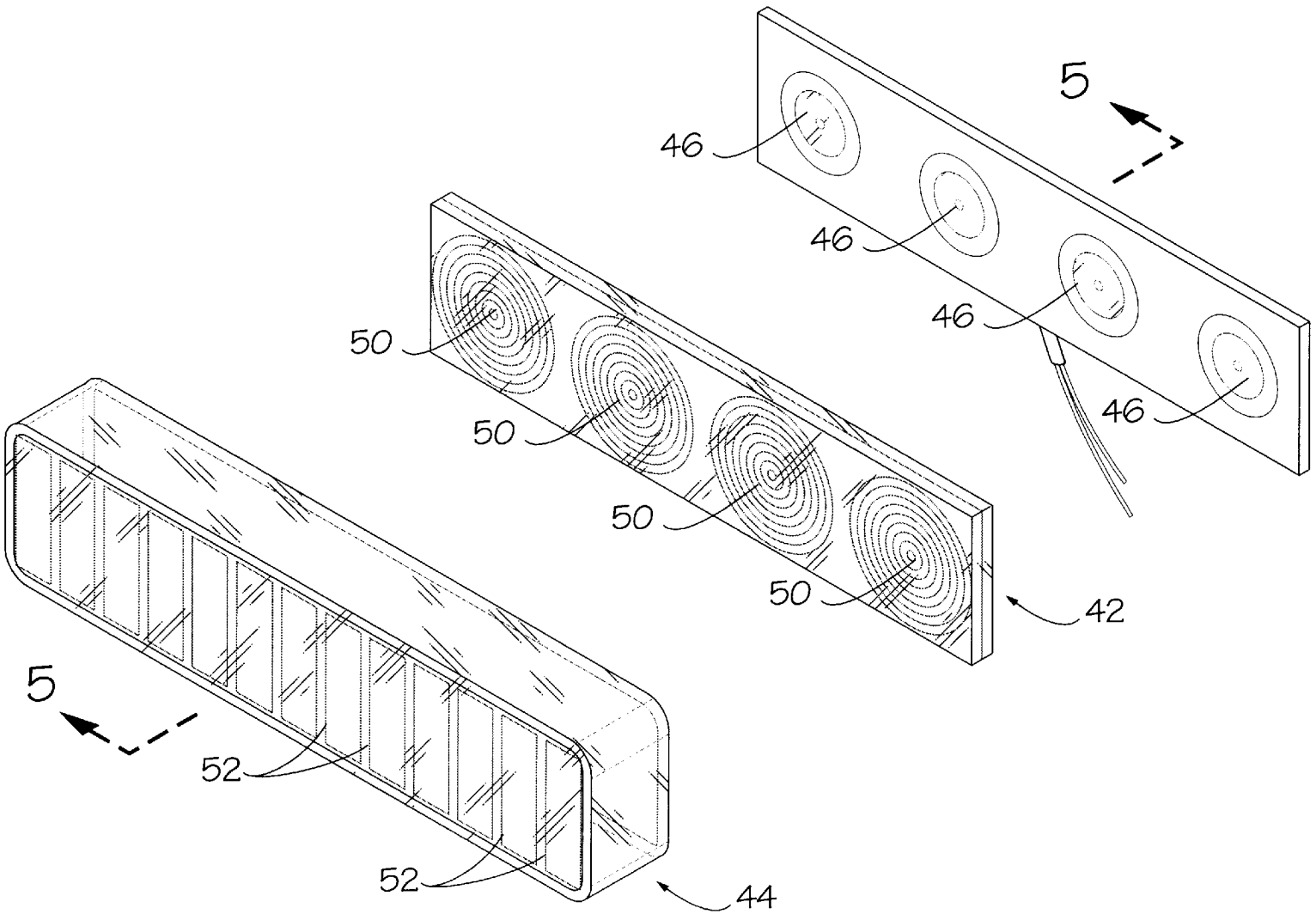
FIG. 4 is an exploded perspective drawing of the lighting assembly showing a strip of light emitting diodes, a light concentrating collimating primary lens strip in series with a light shaping secondary lens strip.
Figure 5:
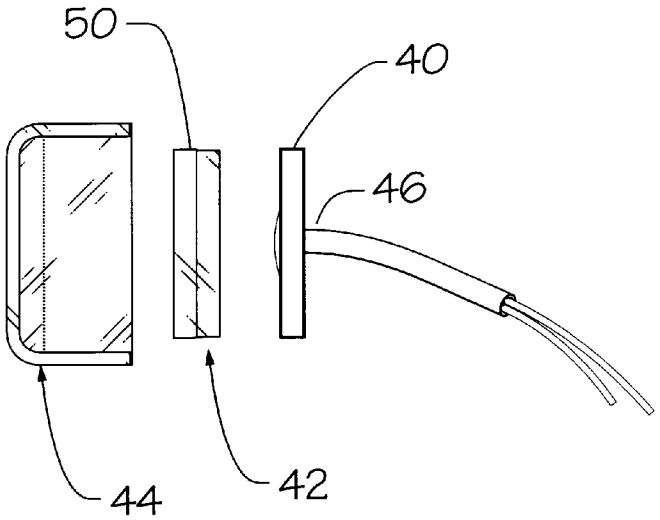
FIG. 5 is a transverse cross sectional drawing taken along line 5—5 of FIG. 4 showing the arrangement of the light emitting diode strip and the primary concentrating collimating and secondary shaping lens strips.

Lighting assembly 24 preferably comprises (FIGS. 4 and 5) a slender, narrow lighting printed circuit card 40, a light concentrating collimating primary lens strip 42 and a light shaping secondary lens strip 44. As shown, preferably at least four light-emitting diodes (LED's) 46 (but in any event, at least one such LED is) are installed through circuit card 30 in a linear, equally spaced-apart relationship. Preferably, the spacing distance, d, between LED's 46 is about one-half inch.

Light from LED's 46 is first focus intensified by collimating lens elements 50 formed in primary lens strip 42, each collimating lens in optical alignment with the LED's (FIGS. 4–6), the lens elements preferably being made of a transparent plastic material. Focused intensified collimated light from first lens elements 50 is then shaped by light shaping secondary lens strip 44 on which are formed a number of closely spaced vertical type lenses 52. In this manner, LED's 46 provide a specific light pattern 18 on step 12.

Figure 6:
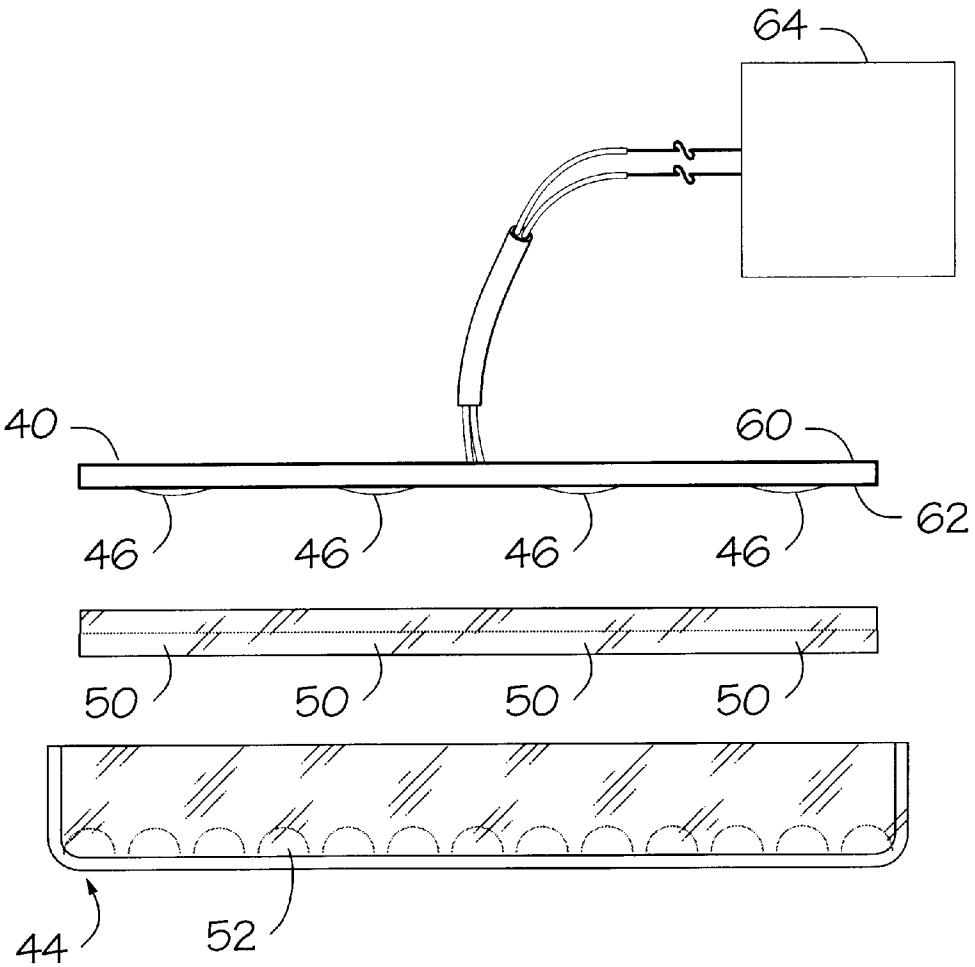
FIG. 6 is an electrical schematic showing the electrical connection to the light emitting diode strip.

LED's 46 of circuit card 24 are, as depicted in FIG. 6, connected together by electrical conduits 60 and 62 which are, in turn, connected to an appropriate voltage source 64, such as a 12 or 24 volt power supply.

Although there has been described above an aisle lighting system 10 in accordance with the present invention for purposes of illustrating the manner in which the present invention maybe used to advantage, it is to be understood that the invention is not limited thereto. Consequently, any and all variations and equivalent arrangements which may occur to those skilled in the applicable art are to be considered to be within the scope and spirit of the invention as set forth in the claims which are appended hereto as part of this application.

What is claimed is:

1. A system for illuminating a specific region of an aisle in a theater, auditorium or the like, the lighting system comprising;

a. a theater or auditorium seat;

b. a light housing attached to an aisle-side of the theater or auditorium seat;

c. at least one individual miniature electric light source;

d. a bracket for mounting said at least one individual miniature light source in said housing and for enabling the light from said at least one light source to be directed at particular regions of said aisle when the housing is mounted on the aisle side of said seat; and e. primary light intensifying collimating lens and secondary light shaping lenses disposed in front of said at least one light source and configured so as to create a relatively uniformly illuminated region of said aisle.

2. The aisle lighting system as claimed in claim 1, wherein said at least one light source comprises a high intensity light emitting diode (LED).

3. The aisle lighting system as claimed in claim 1, including four of said light sources.

4. The aisle lighting system as claimed in claim 3, wherein each of said light sources comprises a high intensity light emitting diode.

5. A system for illuminating a specific region of an aisle in a theater, auditorium or the like, the lighting system comprising;

a. a theater or auditorium seat:

b. a light housing and means for attaching said housing to an aisle-side of said theater or auditorium seat;

c. an aisle lighting assembly mounted in said housing, said lighting assembly including at least four individual miniature electric light sources installed in a spaced apart relationship on a printed circuit card, a primary light intensifying collimating lens strip installed in front of said printed circuit card and a light shaping lens strip installed in front of said primary light intensifying collimating lens strip, so as to cause light from said light sources to illuminate specific regions of said aisle.

6. The aisle lighting system as claimed in claim 5, wherein each of said individual light sources include a high intensity light emitting diode.

7. The aisle lighting system as claimed in claim 5, wherein said primary light intensifying collimating lens strip includes an individual collimating lens in optical alignment with each of said light sources.

8. A system for illuminating a region of an aisle in a theater, auditorium or the like, the lighting system comprising;

a. a row-end theater or auditorium seat;

b. a light housing and means for attaching said housing to an aisle-side of the row-end theater or auditorium seat, said housing having a window facing outwardly and downwardly;

c. a lighting strip having mounted thereto at least four high intensity light emitting diodes mounted in said housing window; and d. a first intensifying, collimating primary lens and a second shaping secondary lens strip installed in series in front of said lighting strip for intensifying, collimating and then shaping light emitted by said light emitting diodes so as to cause relatively uniform illumination of a below-adjacent region of said aisle.

9. A system for illuminating a specific surface region of an aisle in a theater, auditorium or the like, the lighting system comprising:

a row-end theater or auditorium seat;

a light housing attached to the row-end seat, said housing having a window facing outwardly and downwardly;

at least one miniature electric light source;

a bracket for mounting said at least one miniature light source in said housing such that a portion of said housing shields said at least one light source from being viewed from above;

a primary light collimating lens disposed in front of said at least one light source; and a plurality of secondary light shaping lenses disposed in front of said primary lens, said secondary lenses configured to distribute light from the at least one light source to provide relatively uniform illumination of said specific surface region of said aisle.

10. The lighting system of claim 9, wherein said surface region is generally rectangular.

* * * * *